US006150625A

United States Patent [19]

Marchand et al.

[11] Patent Number: 6,150,625

[45] Date of Patent: Nov. 21, 2000

[54] VACUUM CIRCUIT BREAKER WITH CONTACT WEAR INDICATOR TOOL

[75] Inventors: Francois Jean Marchand, Pittsburgh; Edward James Klimek, Jeannette; Thomas Kenneth Fogle, Pittsburgh, all of Pa.; Truc Tran Trung Nguyen, Springfield, Va.

[73] Assignee: Eaton Corporation, Cleveland, Ohio

[21] Appl. No.: 09/416,342

[22] Filed: Oct. 12, 1999

[51] Int. Cl.[7] ..... H01H 33/66

[52] U.S. Cl. ..... 218/118

[58] Field of Search ..... 218/118–140; 335/6, 7, 8, 16, 20

[56] References Cited

U.S. PATENT DOCUMENTS 4,479,042 10/1984 Basnett ..... 218/123

4,743,876 5/1988 Milianowicz et al. ..... 335/20

5,095,293 3/1992 Patel et al. ..... 335/17

*Primary Examiner*—J. R. Scott

*Attorney, Agent, or Firm*—Martin J. Moran

[57] ABSTRACT

An erosion gauge tool for measuring the erosion of a movable contact in a circuit breaker having a stationary contact and movable contact, both of which are sealed in a housing. The movable contact is coupled to a drive insulator. An erosion mark is etched on the housing adjacent to the drive insulator. The erosion gauge tool has a handle, a tab, and a pointer. The tab is adapted to rest on the drive insulator. The pointer is disposed adjacent to erosion mark when said tab is resting on said drive insulator. As the moveable contact erodes, the pointer moves closer to the erosion mark. The erosion gauge is sized to indicate when the moveable contact needs to be replaced, e.g. when the pointer is immediately adjacent to or above the erosion mark.

16 Claims, 1 Drawing Sheet

VACUUM CIRCUIT BREAKER WITH CONTACT WEAR INDICATOR TOOL

BACKGROUND OF THE INVENTION

1. Field of the Invention

This invention relates to a tool for providing a visual indicia of the state of contacts of an interrupter assembly of a circuit breaker where the contacts are not readily visible, and more particularly to a contact erosion gauge for a vacuum circuit breaker assembly that houses the interrupter contacts in a hermetically sealed housing.

2. Background Information

Circuit breakers provide protection for electrical systems from electrical fault conditions such as current overloads, short circuits, and low level voltage conditions. Typically, circuit breakers include a spring-powered operating mechanism which opens electrical contacts to interrupt the current through the conductors in an electrical system in response to abnormal conditions. In particular, vacuum circuit interrupters include separable main contacts disposed within an insulated and hermetically sealed housing. Generally, one of the contacts is fixed relative to both the housing and to an external electrical conductor which is interconnected with the circuit to be protected by the circuit interrupter. The other contact is moveable. In the case of a vacuum circuit interrupter, the moveable contact assembly usually comprises a stem of circular cross-section having the contact at one end enclosed within the vacuum chamber, and a driving mechanism at the other end which is external to the vacuum chamber. In one type of vacuum interrupter, an operating rod assembly is provided which carries a rotatable contact bell crank which is coupled to the operating rod and rotates about a pivot pin upon motion of the operating rod. This plate is connected to the stem of the moveable contacts. The stem is typically affixed to a bellows seal which maintains the vacuum environment within the chamber while enabling movement of the stem and thus the moveable contact. Motion of the plate causes motion of the moveable contact into or out of engagement with the fixed contact.

The operating rod assembly is operatively connected to a latchable operating mechanism which is responsive to current. When an abnormal condition is reached, the latchable operating mechanism becomes unlatched which causes the operating rod to move to the open position. The motion of the operating rod, in turn, causes the contact bell crank to rotate and, as discussed above, this controls motion of the moveable contact and accommodates for wear on the contacts.

Compression springs are provided in the operating rod assembly in order to be able to separate the moveable contact from the fixed contact. In addition, when appropriate circumstances requiring interruption of the circuit do arise, an adequate force is needed to open the contacts with sufficient speed. If the contacts do not open quickly, there is a risk of failure to interrupt the current.

In order to achieve the adequate interrupt speed and force, the springs are mounted on the operating rod assembly. The springs are typically mounted towards one end of the operating rod on what is referred to as the contact wipe portion of the operating rod assembly. Contact wipe refers to the force required to hold the vacuum interrupter contacts closed and the energy to force the contacts open with sufficient speed for safe and clean interruption as discussed above. As noted above, the contact springs which comprise part of the contact wipe assembly must provide the force to hold the contacts closed and the energy to drive them open with appropriate speed. In a typical case, the spring is held on the operating rod between a disk-spacer member which is carried along by the operating rod and a shoulder portion of a set of contact wipe plates which are mounted at one end of the operating rod and spaced apart from the spacer member. When the contacts are closed, the operating rod travels toward its closed position. The contact wipe plates are slidably mounted on the operating rod at the same point at which the rotatable contact bell crank is mounted. When the contacts seat, motion of the contact wipe plates stop. However, motion of the operating rod continues until it travels to its full extended position. At this point, the spring is fully compressed between the spacer member and the shoulder section of the contact wipe plates.

U.S. Pat. No. 5,095,293 appears to describe the first known method of visually checking (without measurements) the spring compression (or tension) to determine whether it is adequate. Adequate spring compression is, in one respect, an indication of the contacts being in good condition. This is because contacts which are worn would require a greater degree of travel by the contact wipe plates which would mean that the compression of the springs between the shoulder portion of the contact wipe plates and the disk-shaped spacer would not be as great. U.S. Pat. No. 5,095,293 describes a convenient and easy to use inspection apparatus for use with the contact wipe springs from which the compression of the springs can be visually inspected. This serves as an indication of the correct contact force and indirectly provides an indication of the integrity of the contacts without requiring disassembly of the circuit breaker or any portion of it. The inspection apparatus employs an operating rod extension tongue received between the contact wipe plates. A visual indicia of the degree of motion between the contact wipe plates and the extension tongue of the operating rod provides a reading of adequacy of spring compression which, in turn, indirectly relates to the integrity of the contacts of the breaker.

While this indicia of contact wear functions well in the prior art vacuum interrupter design, more recent larger, higher voltage, more compact vacuum interrupter designs have found that extensions of the operating rods and/or stems are not readily visible outside the housing designs of these new breakers. Molded insulation casings housing these larger designs have, in general, made it more difficult to observe the moveable operating components within the high voltage portion of the breaker.

Accordingly, there is a need for a tool to measure contact wear that is more readily visible to maintenance personnel and will not interfere with the other operating components associated with the circuit interrupter nor inhibit replacement of the vacuum interrupter when it has expended its useful life.

There is a further need for such a tool to be inexpensive and easy to use.

There is a further need for such a tool to be compatible with existing circuit breakers.

SUMMARY OF THE INVENTION

The present invention satisfies the above referenced needs and others by providing an erosion gauge tool which clearly provides and indication of the level of wear of the contacts housed in the vacuum chamber. The amount of erosion of the contacts can be determined by comparing the distance between a fixed locator feature and a locator feature on the movable contact stem and/or drive insulator. When the moveable contact is new, the locator feature on the stem and/or drive insulator will be a certain distance from the fixed locator feature when the contacts are closed. As the contacts wears, the movable contact must travel further to be in the closed position. Therefore, the distance between fixed locator feature and the locator feature on the movable stem and/or drive insulator will vary.

The erosion gauge tool measures the change in the distance between a fixed locator feature and a locator feature on the movable stem and/or drive insulator. The erosion gauge tool works in conjunction with a mark etched on the circuit breaker housing. When new, and therefore uneroded, contacts are installed in the circuit breaker an etching tool, which rests on the circuit breaker drive insulator, is used to mark the circuit breaker housing with an erosion mark. The erosion gauge tool also rests on the drive insulator and provides a pointer which, when compared to the erosion mark, indicates the level of wear of the contacts.

The drive insulator is attached between the moveable contact's stem and the bell crank. As such, the drive insulator moves vertically as the movable contact is opened or closed. Because a contact which is worn requires a greater degree of travel, as the contact erodes, the drive insulator must travel a greater vertical distance to place the contacts in the closed condition. Thus, an indicator which can be consistently placed at the same location on the drive insulator will change its position relative to a stationary mark on the circuit breaker housing.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
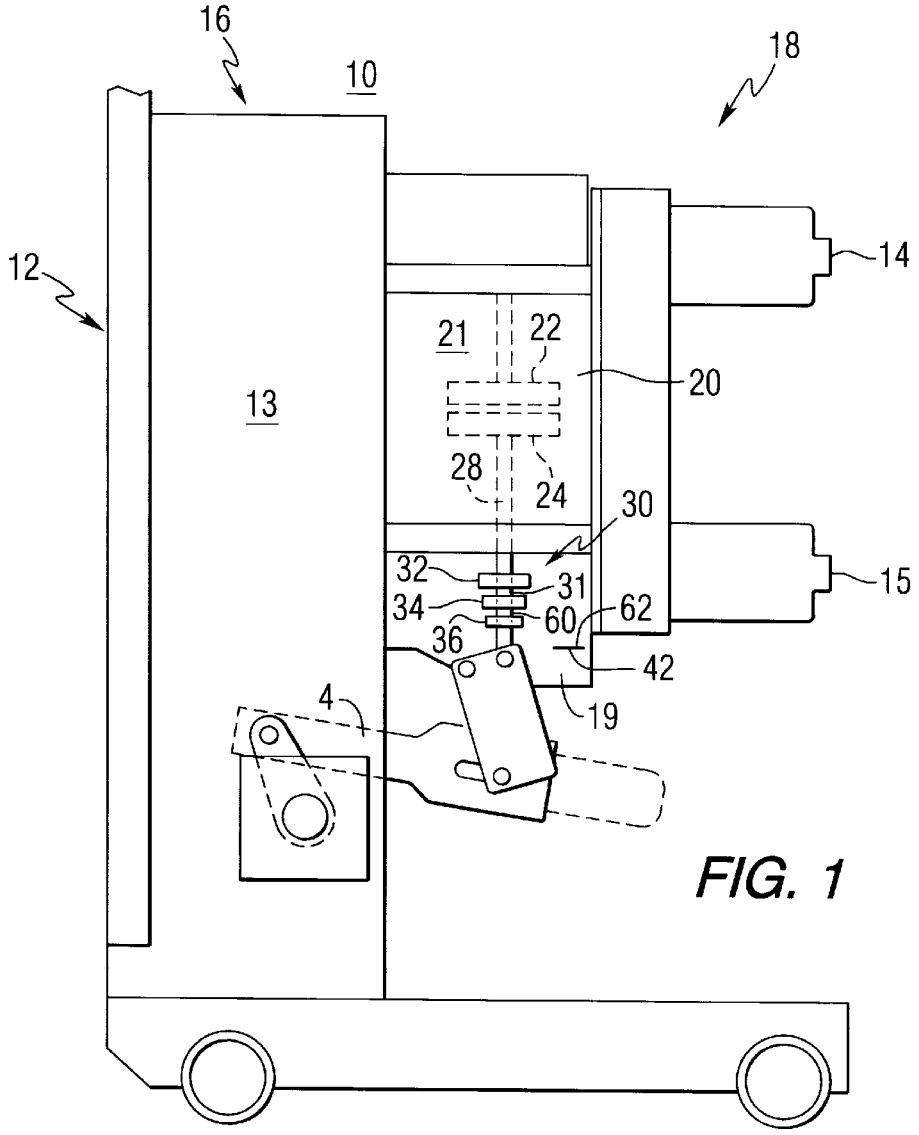
FIG. 1 is side elevation view of a circuit breaker having a vacuum interrupter assembly which is operated by a bell crank.

Referring to FIG. 1, there is illustrated a circuit breaker 10 incorporating a vacuum interrupt apparatus 20. The circuit breaker 10 preferably includes a front panel 12 which has controls for manually operating the circuit breaker 10 and changing the state of the contacts to either an open or closed condition and a circuit breaker housing 13. The circuit breaker has an upper and a lower terminal 14 and 15, and may have additional terminals not visible in FIG. 1, which can be connected to a line-in (not shown) and a load (not shown). The circuit breaker 10 has a low voltage portion 16 adjacent to the front panel 12 and a high voltage portion 18 including the circuit interrupter assembly 20. The vacuum interrupter assembly 20 includes vacuum chamber support housing 19, a vacuum chamber 21 which encloses a pair of separable contacts including a stationary contact 22 and a moveable contact 24 within a vacuum housing 26.

Details about the operating mechanism for moving the contacts 22 and 24 between an open and closed condition are described in detail in U.S. Pat. No. 4,743,876, which is owned by the assignee of the present application. U.S. Pat. No. 4,743,876 is herein incorporated by reference in its entirety. Generally, as shown in FIG. 1, the vacuum interrupter assembly 20 encloses the stationary contact 22 and the moveable contact 24. The stationary contact 22 is coupled to the upper terminal 14 and the moveable contact 24 is coupled to the lower terminal 15. The moveable contact 24 further includes a stem 28 which protrudes from the vacuum chamber 21. The stem 28 is coupled to the drive insulator 30 which is further coupled to the operating mechanism 4. The drive insulator 30 is a cylindrical body 31 made from a dielectric material. The cylindrical body 31 has a plurality of spaced disks 32, 34, 36 extending therefrom.

Because the contacts 22, 24 are located in the sealed vacuum chamber 21, the erosion of the contacts 22, 24 must be measured as compared to a reference point external to the vacuum chamber 21. This is most easily accomplished by identifying a first, movable locator feature 60 on the stem 28 or drive insulator 30 and a second locator feature 62 that is non-movable. The locator features 60, 62 may be marks added to the circuit breaker 10 or structural components of the circuit breaker 10 or a combination thereof. The identification of the first and second locator features 60, 62 is preferably accomplished when the movable contact 24 is new and will hereinafter be referred to as the original position. Because the stem 28 and drive insulator 30 are coupled to, and move with, the movable contact 24, as the movable contact erodes, the movable locator feature 60 on the stem 28 or drive insulator 30 will be in a different position when compared to the stationary locator feature 62. Noting that, typically, the stem 28 and drive insulator 30 must be in a higher position as the movable contact 24 wears, the distance between the locator features 60, 62 may grow larger, e.g., if in the original position the second locator feature 62 is below the first locator feature 60, or may grow smaller, e.g., if in the original position the second locator feature 62 is above the first locator feature 60. Thus, determining the amount of wear on the contacts 22, 24 can be accomplished by comparing the relative positions of the first and second locator features 60, 62 as the movable contact 24 erodes. When the relative positions of the first and second locator features 60, 62 are beyond a predetermined tolerance, at least one contact 22, 24 needs to be replaced.

Any two suitable points may be identified as the first and second locator features 60, 62. For example, the second locator feature 62 could be a non-moving structure on the circuit breaker. In the preferred embodiment, however, an etching tool is used to mark the second locator feature 62 on the circuit breaker housing 13 or vacuum chamber support housing 19. In the preferred embodiment, the etching tool includes a tab and a stylus. The tab rests on the upper surface of one of the drive insulator disks 36. The stylus is then used to mark a fixed point on the circuit breaker housing 13 or vacuum chamber support housing 19. This is preferably performed prior to the first use of the circuit breaker or just after a new moveable contact has been installed. As such, the mark 42 on the circuit breaker housing will indicate the second locator feature 62.

Figure 2:
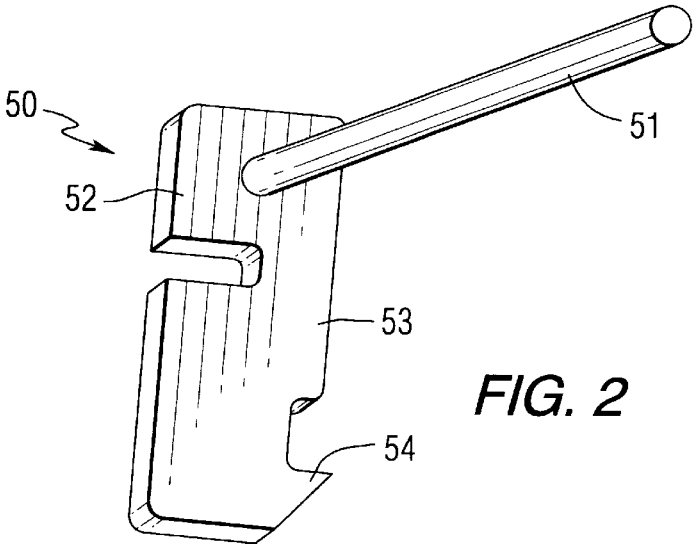
FIG. 2 is a perspective view of the erosion gauge tool.

An erosion gauge tool 50 has a means for comparing the distance between the first and second locator features 60, 62. For example, the tool may have a predetermined length and the locator features 60, 62 are compared to the top and bottom edges of the tool. In the preferred embodiment, the erosion gauge tool 50 cooperates with the mark 42 made by the etching tool. As shown in FIG. 2, the erosion gauge tool 50 includes a handle 51, a tab 52 which will rest upon the drive insulator disk 36, a body 53 and a pointer 54 which, when the erosion gauge tool 50 is resting on the drive insulator disk 36, will be disposed adjacent to the erosion mark 42. By resting the tab 52 on the drive insulator disk 36, the top of the drive insulator disk 36 becomes the first locator feature 60. Thus, erosion of the movable contact can be measured by comparing the position of the first locator feature 60 and the second locator feature 62 by using the erosion gauge tool 50.

In the preferred embodiment, the second locator feature 62 is located below first locator feature 60 in the original position. Additionally, the distance between the tab 52 and the pointer 54 on the erosion gauge tool 50 is greater than the space between the tab and the stylus on the etching tool. As such, when the erosion gauge tool 50 is mounted on a drive insulator disk 36 when the moveable contact is new, the pointer 54 will be located below the erosion mark 42. As the circuit breaker 10 is opened and closed, the contacts 22, 24 will erode, thus requiring the drive stem 28 and the drive insulator 30 to travel a greater vertical distance to reach the contact's closed position. When the erosion gauge tool 50 is resting on a drive insulator disk 36 where the moveable contact 24 is eroded and in the closed position, the pointer 54 will be closer to the erosion mark 42. The space between the pointer 54 and the tab 52 is preferably sized so that when the pointer 54 is immediately adjacent to, or above, the erosion mark 42, the erosion gauge tool indicates that the contacts 22, 24 are worn beyond the maximum allowable amount and at least one contact 22, 24 must be replaced.

While specific embodiments of the invention have been described in detail, it will be appreciated by those skilled in the art that various modification and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An erosion gauge tool for a circuit breaker having a stationary contact and movable contact, movable between an open position and a closed position, both of which are sealed in a vacuum chamber housing, said movable contact being coupled to a stem carrying a drive insulator, a first locator feature being identified on said stem and/or drive insulator and a second, stationary locator feature being identified on said circuit breaker, said erosion gauge tool comprising:

a body having a fixed dimension establishing spacing between said first locator feature and said second locator feature at a maximum allowable erosion of said contacts.

2. The erosion gauge tool of claim 1, wherein said second locator feature is an erosion mark on said housing and said body includes a pointer.

3. The erosion gauge tool of claim 2, wherein said body includes a tab adapted to rest on said stem.

4. The erosion gauge tool of claim 3, wherein the distance between said tab and said pointer is sized to indicate that at least one said contact needs to be replaced when said contacts are in said closed position, and said tool is resting on said stem and said pointer is beyond a predetermined tolerance when compared to said erosion mark.

5. The erosion gauge tool of claim 2, wherein said body includes a tab adapted to rest on said drive insulator.

6. The erosion gauge tool of claim 5, wherein the distance between said tab and said pointer is sized to indicate that at least one said contact needs to be replaced when said contacts are in said closed position, and said tool is resting on said drive insulator and said pointer is beyond a predetermined tolerance when compared to said erosion mark.

7. A circuit breaker with an erosion gauge tool comprising:

a sealed vacuum chamber;

a first stationary contact sealed within the vacuum chamber;

a first electrical conductor connected to the first stationary contact at one end, sealably penetrating the vacuum chamber and terminating at the other end in a first electrical connector;

a moveable contact sealed within the vacuum chamber and moveable between a first position, out of electrical communication with the first stationary contact, and a second position, in electrical communication with the stationary contact;

a second electrical conductor in electrical communication with the moveable contact at one end and terminating at the other end in a second electrical connector;

means for moving the moveable contact between the first and second positions in response to an actuation command;

a stem coupling said means for moving the movable contact to said movable contact;

a drive insulator coupled to said stem, said drive, insulator having at least one disk;

a first feature identified on said stem or drive insulator;

a second feature identified on said circuit breaker;

an erosion gauge tool having a body having a fixed dimension establishing spacing between said first locator feature and said second locator feature at a maximum allowable erosion of said contacts.

8. The circuit breaker of claim 7, wherein said second feature is an erosion mark on said housing and said body includes a pointer.

9. The circuit breaker of claim 8, wherein said body includes a tab adapted to rest on said stem.

10. The circuit breaker of claim 9, wherein the distance between said tab and said pointer is sized to indicate that at least one said contact needs to be replaced when said contacts are in said closed position, and said tool is resting on said stem and said pointer is beyond a predetermined tolerance when compared to said erosion mark.

11. The circuit breaker of claim 8, wherein said body includes a tab adapted to rest on said drive insulator.

12. The circuit breaker of claim 11, wherein the distance between said tab and said pointer is sized to indicate that at least one said contact needs to be replaced when said contacts are in said closed position, and said tool is resting on said drive insulator and said pointer is beyond a predetermined tolerance when compared to said erosion mark.

13. A method of measuring the erosion of the movable contact in a circuit breaker having a stationary contact and movable contact, movable between an open position and a closed position, both of which are sealed in a vacuum chamber housing, said movable contact being coupled to a stem and a drive insulator, said method comprising the following steps:

a) identifying a first locator feature on said stem and/or drive insulator;

b) identifying a stationary second locator feature on said circuit breaker below said first feature;

c) operating said circuit breaker for a period of time;

d) providing an erosion gauge tool having a means for comparing the distance between said first and said second locator features;

f) comparing the location of said first and second locator features;

g) replacing at least one said contact if said first and second locator features are beyond a predetermined distance.

14. The method of claim 13 further comprising the steps of:

h) marking said second feature on said circuit breaker housing with an erosion mark.

15. The method of claim 14 further comprising the steps of:

i) providing an erosion gauge tool having a tab and a pointer wherein said pointer is spaced from said tab to indicate the maximum allowable erosion of said contacts;

j) resting said tab on said stem or drive insulator;

k) comparing the location of said pointer to said erosion mark;

l) replacing at least one said contact if the comparison of said pointer to said erosion mark indicates that said contacts are worn beyond the maximum allowable amount.

16. The method of claim 15 further comprising the step:

operating said circuit breaker until the comparison of said pointer to said erosion mark indicates that said contacts are worn beyond the maximum allowable amount.

* * * * *